US011346252B2

(12) United States Patent
Giannakopoulos et al.

(10) Patent No.: US 11,346,252 B2
(45) Date of Patent: May 31, 2022

(54) MULTI-PURPOSE ANTI-ROTATION LOCK PIN

(71) Applicant: United Technologies Corporation, Farmington, CT (US)

(72) Inventors: Konstantinos Panagiotis Giannakopoulos, Middletown, CT (US); Thomas Carlsen, Greer, SC (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 192 days.

(21) Appl. No.: 16/458,729

(22) Filed: Jul. 1, 2019

(65) Prior Publication Data

US 2021/0003035 A1 Jan. 7, 2021

(51) Int. Cl.
*F01D 25/24* (2006.01)
*F01D 9/02* (2006.01)
(Continued)

(52) U.S. Cl.
CPC ..... *F01D 25/246* (2013.01); *F01D 9/02* (2013.01); *F01D 11/005* (2013.01);
(Continued)

(58) Field of Classification Search
CPC ..... F01D 25/24; F01D 25/246; F01D 25/28; F01D 9/02; F01D 11/005; F01D 25/265;
(Continued)

(56) References Cited

U.S. PATENT DOCUMENTS 2,848,156 A * 8/1958 Oppenheimer ..... F01D 11/001 415/108
2,915,281 A * 12/1959 Ridley ..... F01D 9/042 415/209.2
(Continued)

FOREIGN PATENT DOCUMENTS

DE 826673 C * 1/1952 ..... F01D 25/246
WO 2015109292 A1 7/2015

OTHER PUBLICATIONS

EPO search report and search opinion of foreign filing of instant application (Year: 2020).*
(Continued)

*Primary Examiner* — Woody A Lee, Jr.
*Assistant Examiner* — Wesley Le Fisher
(74) *Attorney, Agent, or Firm* — Cantor Colburn LLP

(57) ABSTRACT

A case assembly for a gas turbine engine includes a case extending circumferentially about an engine central longitudinal axis and two or more components installed in the case at different axial and/or radial locations. A retainer is installed at a circumferential end of the case, the retainer configured to circumferentially retain the two or more components at the case. A circumferential retainer of a case assembly of a gas turbine engine includes a retainer pin configured for installation in retaining feature of a circumferential end of a case, and one or more retainer arms extending from the retainer pin. The one or more retainer arms are configured to extend at least partially across two or more components installed in the case at different axial and/or radial locations to circumferentially retain the two or more components at the case.

13 Claims, 4 Drawing Sheets

(51) Int. Cl.
*F01D 11/00* (2006.01)
*F01D 25/26* (2006.01)

(52) U.S. Cl.
CPC ..... *F01D 25/265* (2013.01); *F05D 2220/32* (2013.01); *F05D 2240/55* (2013.01); *F05D 2260/30* (2013.01)

(58) Field of Classification Search
CPC ..... F04D 29/52; F04D 29/522; F04D 29/526; F04D 29/60; F04D 29/601; F04D 29/64; F04D 29/644
See application file for complete search history.

(56) References Cited

U.S. PATENT DOCUMENTS 3,056,583 A * 10/1962 Varadi ..... F01D 25/246 415/209.2
3,141,651 A * 7/1964 Moyer ..... F01D 11/08 415/136
3,155,395 A * 11/1964 Hoffman ..... F16J 15/4472 277/416
3,341,172 A 9/1967 Rahaim
3,580,692 A * 5/1971 Mikolajczak ..... F01D 11/127 415/173.4
4,436,311 A * 3/1984 Brandon ..... F01D 11/025 277/413
4,856,963 A * 8/1989 Klapproth ..... F01D 9/042 415/190
6,695,316 B2 * 2/2004 Popa ..... F16J 15/442 277/411
7,677,867 B2 3/2010 Chekanov et al.
10,094,244 B2 * 10/2018 Fitzpatrick ..... F02C 7/20
10,280,801 B2 5/2019 Hafner et al.
2016/0222828 A1 * 8/2016 McCaffrey ..... F01D 25/24
2019/0301295 A1 * 10/2019 Hernandez ..... F01D 5/066

OTHER PUBLICATIONS

English translation of DE826673C (Year: 1952).*
NPL Basic Mechanical Engineering, "Gas Turbine Power Plant With Regeneration, Reheating and Intercooling", basicmechanicalengineering.com, (Year: 2017).*

* cited by examiner

MULTI-PURPOSE ANTI-ROTATION LOCK PIN

STATEMENT OF FEDERAL SUPPORT

This invention was made with Government support awarded by the United States. The Government has certain rights in the invention.

BACKGROUND

Exemplary embodiments of the present disclosure pertain to the art of retention of seal elements in cases of gas turbine engines. More particularly, the present disclosure relates to circumferential retention of seals in gas turbine engine cases.

In gas turbine engine assemblies, components such as stator segments, blade outer airseals and W-seals are installed into grooves or other features in split cases of the engine. The split cases, with the components installed, are then assembled to the rotor or rotors of the engine. It is desired to provide a feature that prevents the components from circumferentially shifting or "walking" once the components are installed in the split case.

BRIEF DESCRIPTION

In one embodiment, a case assembly for a gas turbine engine includes a case extending circumferentially about an engine central longitudinal axis and two or more components installed in the case at different axial and/or radial locations. A retainer is installed at a circumferential end of the case, the retainer configured to circumferentially retain the two or more components at the case.

Additionally or alternatively, in this or other embodiments the retainer includes a retainer pin installed in a retaining feature in the case, and one or more retainer arms extending from the retainer pin. The one or more retainer arms are configured to extend at least partially across the two or more components to circumferentially retain the two or more components at the case.

Additionally or alternatively, in this or other embodiments the retainer has a single retainer arm.

Additionally or alternatively, in this or other embodiments the retainer includes at least two retainer arms, a first retainer arm of the at least two retainer arms extending from the retainer pin in a first direction and a second retainer arm of the at least two retainer arms extending in a second direction different from the first direction.

Additionally or alternatively, in this or other embodiments the retainer pin is an interference fit to the retaining feature.

Additionally or alternatively, in this or other embodiments the two or more components include two or more of a blade outer airseal, a W-seal, and a stator assembly.

Additionally or alternatively, in this or other embodiments the retainer is configured to circumferentially retain a blade outer airseal located at a first axial location in the case and a second blade outer airseal located as a second axial location different from the first axial location.

Additionally or alternatively, in this or other embodiments the case is one of a turbine case or compressor case of a gas turbine engine.

In another embodiment, a gas turbine engine includes a combustor, a turbine section through which combustion gases are directed, and a compressor section to provide airflow to the combustor for combustion. One or more of the turbine section or the compressor section include a case assembly including a case extending circumferentially about an engine central longitudinal axis and two or more components installed in the case at different axial and/or radial locations. A retainer is installed at a circumferential end of the case, the retainer configured to circumferentially retain the two or more components at the case.

Additionally or alternatively, in this or other embodiments the retainer includes a retainer pin installed in a retaining feature in the case, and one or more retainer arms extending from the retainer pin, the one or more retainer arms configured to extend at least partially across the two or more components to circumferentially retain the two or more components at the case.

Additionally or alternatively, in this or other embodiments the retainer has a single retainer arm.

Additionally or alternatively, in this or other embodiments the retainer includes at least two retainer arms, a first retainer arm of the at least two retainer arms extending from the retainer pin in a first direction and a second retainer arm of the at least two retainer arms extending in a second direction different from the first direction.

Additionally or alternatively, in this or other embodiments the retainer pin is an interference fit to the retaining feature.

Additionally or alternatively, in this or other embodiments the two or more components include two or more of a blade outer airseal, a W-seal, and a stator assembly.

Additionally or alternatively, in this or other embodiments the retainer is configured to circumferentially retain a blade outer airseal located at a first axial location in the case and a second blade outer airseal located as a second axial location different from the first axial location.

In yet another embodiment, a circumferential retainer of a case assembly of a gas turbine engine includes a retainer pin configured for installation in retaining feature of a circumferential end of a case, and one or more retainer arms extending from the retainer pin. The one or more retainer arms are configured to extend at least partially across two or more components installed in the case at different axial and/or radial locations to circumferentially retain the two or more components at the case.

Additionally or alternatively, in this or other embodiments the retainer has a single retainer arm.

Additionally or alternatively, in this or other embodiments the retainer includes at least two retainer arms, a first retainer arm of the at least two retainer arms extending from the retainer pin in a first direction and a second retainer arm of the at least two retainer arms extending in a second direction different from the first direction.

Additionally or alternatively, in this or other embodiments the retainer pin is an interference fit to the retaining feature.

Additionally or alternatively, in this or other embodiments the retainer is configured to circumferentially retain a blade outer airseal located at a first axial location in the case and a second blade outer airseal located as a second axial location different from the first axial location.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
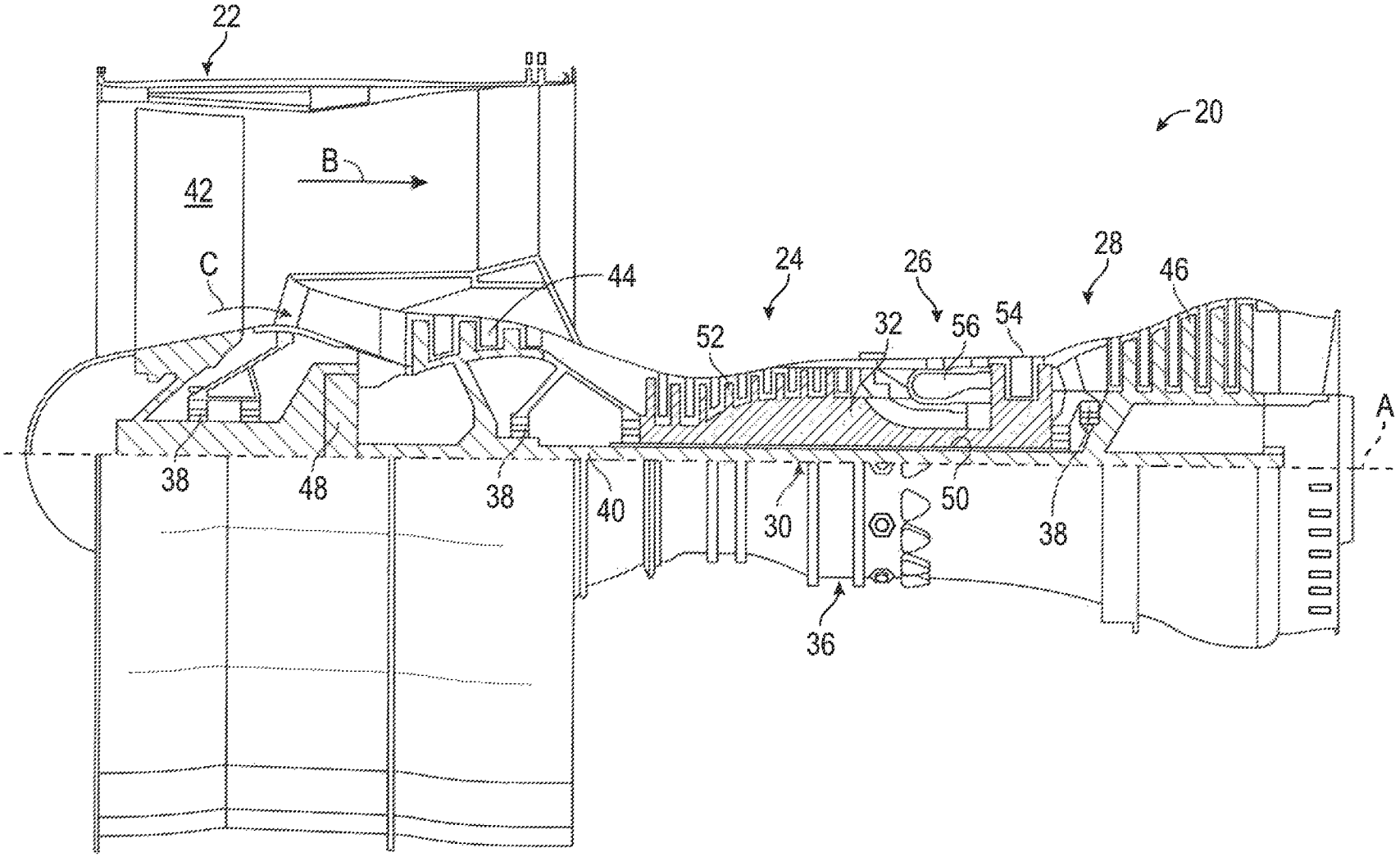
FIG. 1 is a partial cross-sectional view of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure compressor 44. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20, in one example, is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

Figure 2:
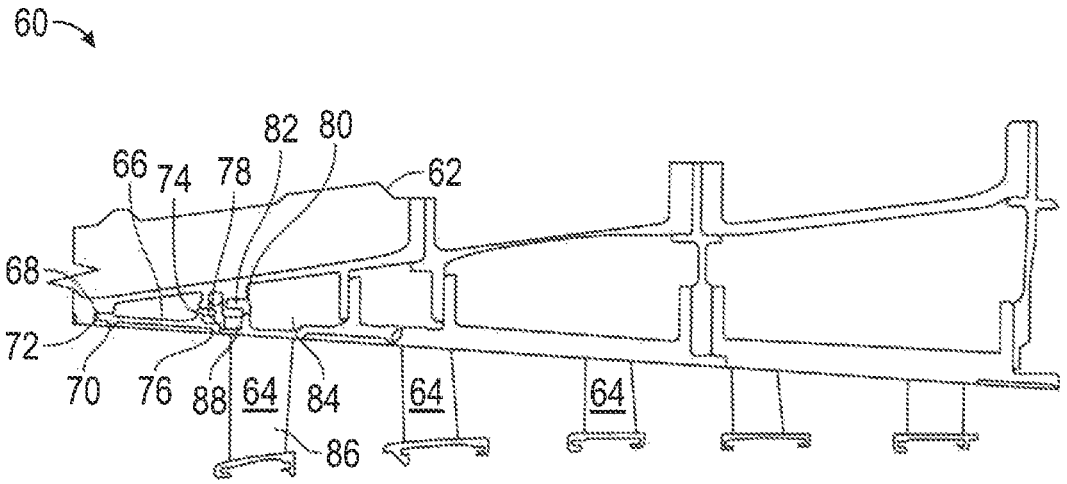
FIG. 2 is a partial cross-sectional view of a case assembly of a gas turbine engine.

Referring to FIG. 2, shown is a case assembly 60, which may be of the compressor section 24 or the turbine section 28. The case assembly 60 includes a case 62 and a plurality of stator assemblies 64 installed thereto. Further, a plurality of blade outer airseals 66 are installed into the case 62. In some embodiments, blade outer airseals 66 are located axially between stator assemblies 64.

Figure 3:
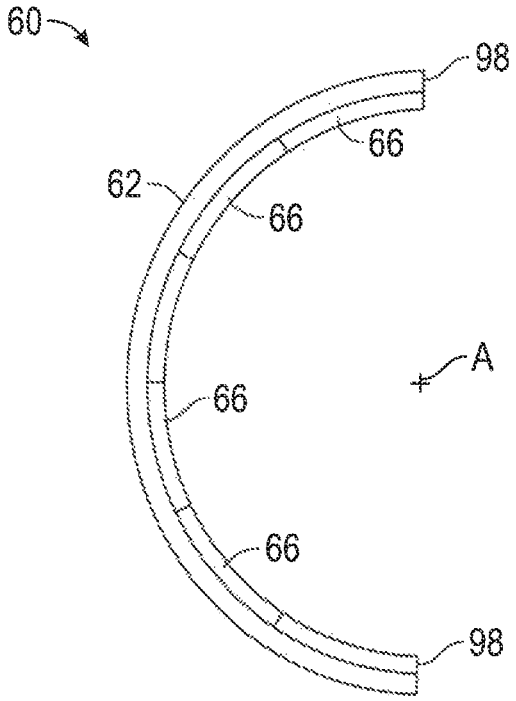
FIG. 3 is a partial axial cross-sectional view of an embodiment of a case assembly of a gas turbine engine.

Referring to the axial cross-sectional view of FIG. 3, the case 62 is a split case having a circumferential span of 180 degrees. Blade outer airseals 66 are arcuate segments installed circumferentially end-to-end in the case 62. In some embodiments, as shown in FIG. 2, the blade outer airseal 66 has an upstream tab 68 at an upstream end 70 of the blade outer airseal 66, which is installed in an upstream airseal case groove 72. Further, the blade outer airseal 66 may have a downstream tab 74 at a downstream end 76 of the blade outer airseal 66, which is installed in a downstream airseal case groove 78 of the case 62. Similarly, stator assemblies 64 are arcuate segments installed end-to-end in the case 62 with stator tabs 80 installed in stator case grooves 82. In some embodiments, stator assemblies 64 include a stator outer platform 84 and a plurality of airfoils 86 extending radially inwardly therefrom. When installed in the case 62 one or more seals, such as W-seals 88 are installed between the stator outer platform 84 and the stator case groove 82.

Figure 4:
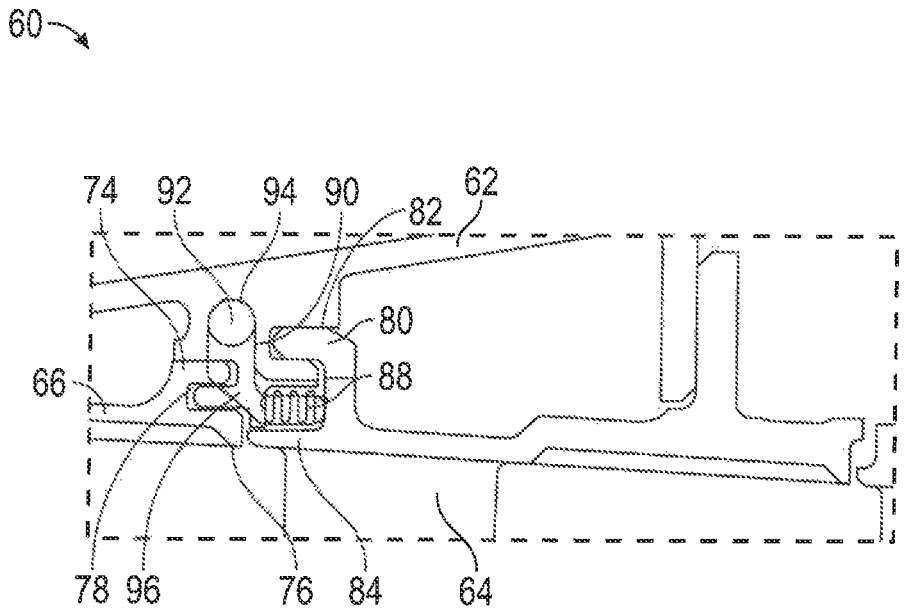
FIG. 4 is a partial cross-sectional view of a retainer arrangement installed in a case assembly.
Figure 5A:
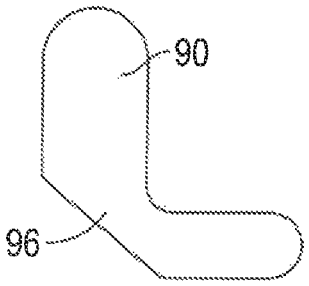
FIGS. 5A-5C are illustrations of an embodiment of a retainer.
Figure 5B:
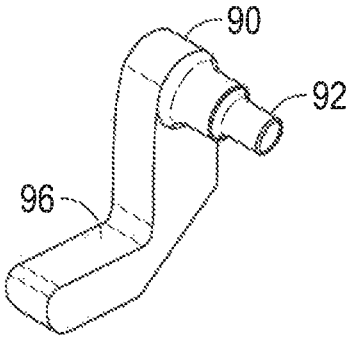
Figure 5C:
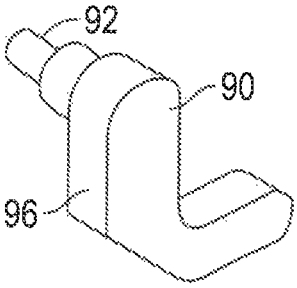

It is desired to circumferentially retain the blade outer airseals 66 stator assemblies 64 and W-seals 88 in the case 62 to prevent circumferential shifting of the components in the case. As such, as shown in FIG. 4, a retainer 90 is installed at a circumferential end 98 of the case 62. The retainer 90 includes a retainer pin 92 (shown best in FIG. 5A-5C) installed in a pin hole 94 formed in the case 62 to axially and radially position the retainer 90 in the case 62. In some embodiments, the pin hole 94 is located in the case 62 radially outboard of the downstream airseal case groove 78 and the W-seal 88, and in some embodiments axially between the W-seal 88 and the downstream airseal case groove 78. In some embodiments, the retainer pin 92 may have an interference fit or press-fit with the pin hole 94.

The retainer 90 includes one or more retainer arms 96 extending from the retainer pin 92 in a radial and/or axial direction from the retainer pin 92. The one or more retainer arms 96 are configured to circumferentially retain two or more components installed at the case 62 at different axial and/or radial locations. The one or more retainer arms 96 extend across the blade outer airseal 66, for example, an upstream tab 68 or a downstream tab 74, thus preventing circumferential movement of the blade outer airseal 66. Further, the one or more retainer arms 96 extend across the W-seal 88 to retain the W-seal 88 at the case 62 and prevent circumferential movement of the W-seal 88 out of the case 62 during assembly, or from traversing circumferentially around the case 62 during operation, thus reducing wear and/or disassembly issues. In some embodiments, such as in FIG. 4, the retainer 90 has a single retainer arm 96, while in other embodiments, multiple retainer arms 96 may extend from the retainer pin 92.

Figure 6:
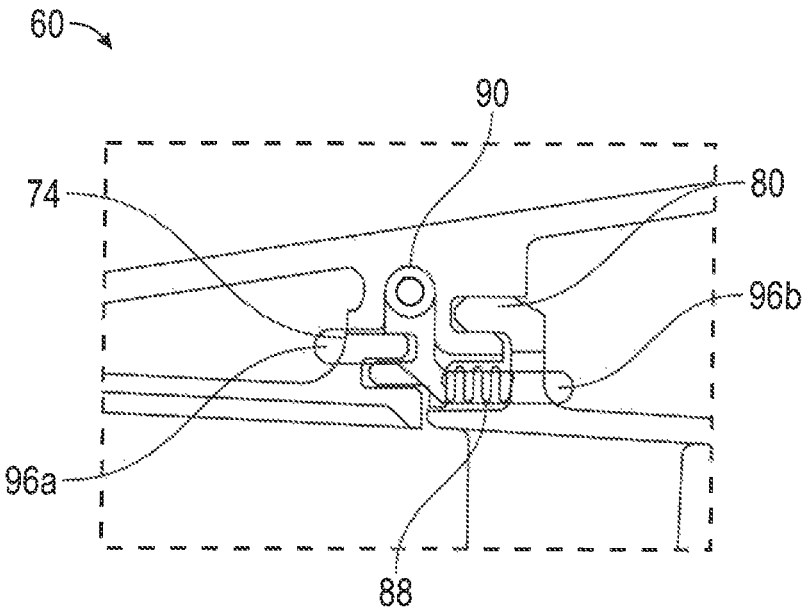
FIG. 6 is a partial cross-sectional view of another retainer arrangement installed in a case assembly.

In another embodiment, shown in FIG. 6, a first retainer arm 96*a* extends in a first direction, for example axially upstream, from the retainer pin 92, and a second retainer arm 96*b* extends in a second direction, for example axially downstream from, the retainer pin 92. In the embodiment of FIG. 6, the first retainer arm 96*a* extends across a downstream tab 74 of the blade outer airseal 66 to circumferentially retain the blade outer airseal 66. The second retainer arm 96*b* extends across both the W-seal 88 and the stator tab 80, thus circumferentially retaining both the W-seal 88 and the stator assembly 64.

Figure 7:
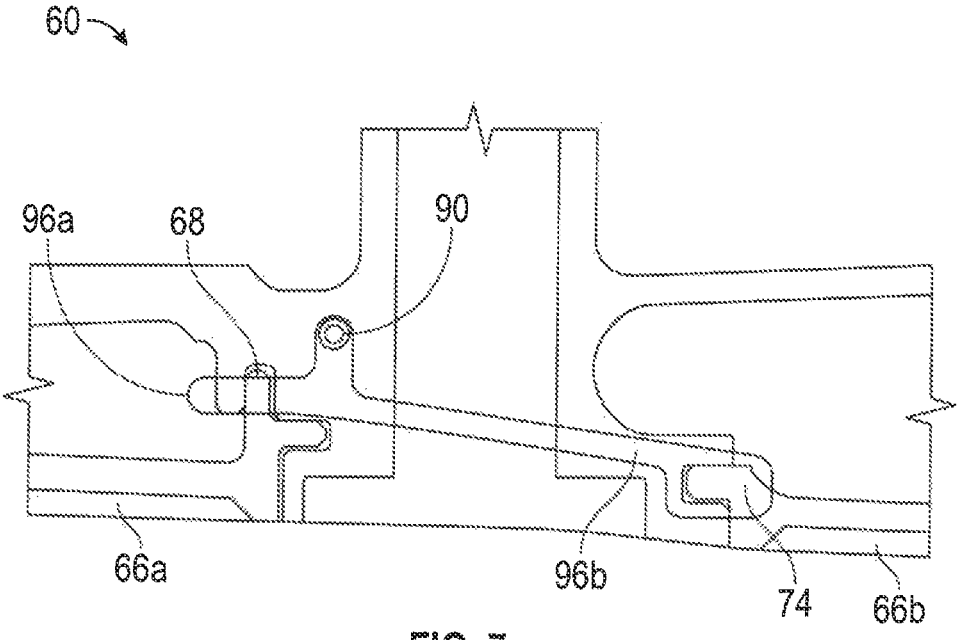
FIG. 7 is a partial cross-sectional view of yet another retainer arrangement installed in a case assembly.

Another configuration of the retainer 90 is shown in FIG. 7. In the embodiment of FIG. 7, the first retainer arm 96*a* extends upstream to retain a first blade outer airseal 66*a*, while a second retainer arm 96*b* extends downstream to retain a second blade outer airseal 66*b*.

The retainer 90 of the present disclosure is configured to retain components, such as blade outer airseals 66, W-seals 88 and stator assemblies 64 at different axial and radial locations to prevent circumferential shifting of the components. Retaining of multiple components with a single retainer 90 simplifies installation and reduces the number of parts and their associated cost.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A case assembly for a gas turbine engine, comprising:
a case extending circumferentially about an engine central longitudinal axis;
two or more components installed in the case at different axial and/or radial locations;
a retainer installed at a circumferential end of the case, the retainer configured to circumferentially retain the two or more components at the case;
wherein the retainer includes:
a retainer pin installed in a retaining feature in the case, the retaining pin installed in the circumferential direction in the retaining feature; and
one or more retainer arms extending from the retainer pin, the one or more retainer arms configured to extend at least partially across the two or more components to circumferentially retain the two or more components at the case;
wherein the two or more components include a blade outer airseal and a W-seal.

2. The case assembly of claim 1, wherein the retainer has a single retainer arm.

3. The case assembly of claim 1, wherein the retainer includes at least two retainer arms, a first retainer arm of the at least two retainer arms extending from the retainer pin in a first direction and a second retainer arm of the at least two retainer arms extending in a second direction different from the first direction.

4. The case assembly of claim 1, wherein the retainer pin is an interference fit to the retaining feature.

5. The case assembly of claim 1, wherein the case is one of a turbine case or compressor case of a gas turbine engine.

6. A gas turbine engine, comprising:
a combustor;
a turbine section through which combustion gases are directed; and
a compressor section to provide airflow to the combustor for combustion;
one or more of the turbine section or the compressor section including a case assembly including:
a case extending circumferentially about an engine central longitudinal axis;
two or more components installed in the case at different axial and/or radial locations; and
a retainer installed at a circumferential end of the case, the retainer configured to circumferentially retain the two or more components at the case;
wherein the retainer includes:
a retainer pin installed in a retaining feature in the case, the retaining pin installed in the circumferential direction in the retaining feature; and
one or more retainer arms extending from the retainer pin, the one or more retainer arms configured to extend at least partially across the two or more components to circumferentially retain the two or more components at the case;
wherein the two or more components include a blade outer airseal and a W-seal.

7. The gas turbine engine of claim 6, wherein the retainer has a single retainer arm.

8. The gas turbine engine of claim 6, wherein the retainer includes at least two retainer arms, a first retainer arm of the at least two retainer arms extending from the retainer pin in a first direction and a second retainer arm of the at least two retainer arms extending in a second direction different from the first direction.

9. The gas turbine engine of claim 6, wherein the retainer pin is an interference fit to the retaining feature.

10. A circumferential retainer of a case assembly of a gas turbine engine, comprising:

a retainer pin configured for installation in a retaining feature of a circumferential end of a case; and one or more retainer arms extending from the retainer pin, the one or more retainer arms configured to extend at least partially across two or more components installed in the case at different axial and/or radial locations to circumferentially retain the two or more components at the case;

wherein the retainer pin is installed in the circumferential direction in the retaining feature;

wherein the two or more components include a blade outer airseal and a W-seal.

11. The circumferential retainer of claim 10, wherein the retainer has a single retainer arm.

12. The circumferential retainer of claim 10, wherein the retainer includes at least two retainer arms, a first retainer arm of the at least two retainer arms extending from the retainer pin in a first direction and a second retainer arm of the at least two retainer arms extending in a second direction different from the first direction.

13. The circumferential retainer of claim 10, wherein the retainer pin is an interference fit to the retaining feature.

* * * * *